US007152618B2

(12) United States Patent
Shimizu et al.

(10) Patent No.: US 7,152,618 B2
(45) Date of Patent: Dec. 26, 2006

(54) VACUUM STATION AND THE METHOD FOR OPERATING THE SAME

(75) Inventors: Osamu Shimizu, Tokyo (JP); Keisuke Ikeda, Tokyo (JP)

(73) Assignee: Ebara Corporation, Tokyo (JP)

( * ) Notice: Subject to any disclaimer, the term of this patent is extended or adjusted under 35 U.S.C. 154(b) by 210 days.

(21) Appl. No.: 10/893,976

(22) Filed: Jul. 20, 2004

(65) Prior Publication Data

US 2005/0016588 A1 Jan. 27, 2005

(30) Foreign Application Priority Data

Jul. 22, 2003 (JP) ..... 2003-277208

(51) Int. Cl.
*B67C 3/16* (2006.01)

(52) U.S. Cl. ..... 137/205; 417/426

(58) Field of Classification Search ..... 137/205; 417/15, 36, 426

See application file for complete search history.

(56) References Cited

U.S. PATENT DOCUMENTS 2,888,875 A * 6/1959 Buck ..... 417/426
3,286,636 A * 11/1966 Schaub ..... 417/28
3,730,884 A * 5/1973 Burns et al. ..... 137/236.1
4,057,364 A * 11/1977 Bratschitsch ..... 137/205
4,155,851 A * 5/1979 Michael ..... 137/236.1
4,179,371 A * 12/1979 Foreman et al. ..... 137/236.1
4,213,479 A * 7/1980 Pearson ..... 137/205
4,713,847 A * 12/1987 Oldfelt et al. ..... 137/205
4,797,834 A * 1/1989 Honganen et al. ..... 417/410.1
5,575,304 A * 11/1996 Hassett ..... 137/205
5,770,053 A * 6/1998 Chotel et al. ..... 137/571
5,960,736 A * 10/1999 Ludington et al. ..... 119/14.08
6,012,477 A * 1/2000 Hagiwara et al. ..... 137/205
6,056,510 A * 5/2000 Miura et al. ..... 417/243

FOREIGN PATENT DOCUMENTS

JP 2684526 8/1997
JP 9-303299 11/1997
JP 11-148456 6/1999

* cited by examiner

*Primary Examiner*—Eric Keasel
*Assistant Examiner*—Cloud Lee
(74) *Attorney, Agent, or Firm*—Westerman, Hattori, Daniels & Adrian, LLP.

(57) ABSTRACT

A vacuum station is used for storing sewage from a vacuum sewage pipe and then delivering the sewage to a sewage treatment plant or the like. The vacuum station includes a collection tank for collecting sewage, a plurality of vacuum pumps for depressurizing and pressurizing an interior of the collection tank, and a controller for controlling the plurality of vacuum pumps. The controller controls at least one of the vacuum pumps so as to rotate in normal direction so that the interior of the collection tank is depressurized to collect sewage into the collection tank, and at least one of the vacuum pumps so as to rotate in reverse direction when the sewage in the collection tank reaches a predetermined sewage level so that the interior of the collection tank is pressurized to discharge the sewage from the collection tank.

4 Claims, 4 Drawing Sheets

FIG. 3

| operating range of vacuum pump (kPa) | allowable pressure loss (kPa) | maximum amount of sewage per hour ($m^3/h$) | collectable population (the number of people) | conditions of location |
|---|---|---|---|---|
| -70～-60 | 40 | 4.94 | 152 | sparsely in a wide area |
| -60～-50 | 30 | 6.93 | 213 | |
| -50～-40 | 20 | 9.62 | 296 | densely in a small area |

VACUUM STATION AND THE METHOD FOR OPERATING THE SAME

BACKGROUND OF THE INVENTION

1. Field of the Invention

The present invention relates to a vacuum station for storing sewage from a vacuum sewage pipe and then delivering the sewage to a sewage treatment plant or the like, and to a method for operating such vacuum station.

2. Description of the Related Art

Heretofore, there has been known a vacuum sewage system which includes a vacuum station having a collection tank and delivers sewage stored in the collection tank to a sewage treatment plant or the like by a pump in the vacuum station. The vacuum station is the equipment in which vacuum serving as a driving force for collecting sewage is created, and the collected sewage is temporarily stored and then transported to a sewage treatment plant, a sewage relay pump station, or a gravity trunk sewer. The vacuum station comprises a vacuum generating apparatus for generating vacuum, a collection tank for temporarily storing collected sewage, a sewage pump for transporting the sewage from the collection tank, and a controller for controlling these equipment.

As a form of vacuum station, there has been a vacuum station in which equipment including a collection tank, a sewage pump, a vacuum pump and the like is provided on the first basement of independently reinforced concrete construction (first story and first basement), and equipment including a controller, a feed tank, a deodorizing device and the like is provided on the first story of the independently reinforced concrete construction. However, this type of vacuum station causes a clogging problem of the sewage pump by foreign matter and a problem of high equipment cost.

On the other hand, in a small-scale vacuum sewage system (for example, expected to be used for about 3 hundred residents), there has been known a unit-type vacuum station which incorporates an ejector in place of a vacuum pump and a sewage circulating pump installed in a manhole because the facility structure is simple and a site for the vacuum station is not required. The ejector-type vacuum station has the advantage of eliminating the need for a vacuum pump, and omitting a sewage pump because a collecting tank without an enclosed structure allows the collected sewage to be discharged therefrom by gravity, thus simplifying the facility structure. However, there is a possibility that the ejector is clogged with foreign matter because an ejector nozzle allows only small-diameter foreign matter to pass therethrough, and the ejector has a low ultimate pressure ranging from −60 kPa to −50 kPa and a low operating efficiency.

Therefore, in a small-scale vacuum station, there has been demanded a vacuum station which is hardly clogged with foreign matter in sucking and discharging sewage, requires a reduced facility cost, and has a good operating efficiency.

For example, in the vacuum sewage system disclosed in Japanese Patent Publication No. 2684526, a single roots-type multistage vacuum pump is used, and normal rotation and reverse rotation of such vacuum pump are automatically controlled, whereby suction of sewage into a collection tank and discharge of the sewage from the collection tank are performed alternately. In this vacuum sewage system, since sewage can be collected or discharged without using a sewage pump, clogging of the system caused by foreign matter hardly occurs, an ultimate pressure is high and operating efficiency is also high because the vacuum pump is employed.

However, in the vacuum sewage system disclosed in Japanese Patent Publication No. 2684526, since only a single collection tank and a single roots-type multistage vacuum pump are provide, if the vacuum pump breaks down, then collection and discharge of sewage cannot be performed. Since the vacuum sewage system is used for the public, it is essential to ensure the safety to prevent the entire system from malfunctioning owing to a breakdown of the vacuum pump, or the like.

SUMMARY OF THE INVENTION

It is therefore an object of the present invention to provide a vacuum station in which clogging by foreign matter is unlikely to occur in sucking and discharging sewage, facility costs are reduced, and operating efficiency and stability in system operation are increased.

Another object of the present invention is to provide a method for operating the above vacuum station.

According to a first aspect of the present invention, there is provided a vacuum station comprising: a collection tank for collecting sewage; a plurality of vacuum pumps for depressurizing and pressurizing an interior of the collection tank; a sewage inlet pipe connected to the collection tank; a sewage discharge pipe connected to the collection tank; and a controller for controlling the plurality of vacuum pumps; wherein the controller controls at least one of the vacuum pumps so as to rotate in normal direction so that the interior of the collection tank is depressurized to collect sewage into the collection tank through the sewage inlet pipe, and at least one of the vacuum pumps so as to rotate in reverse direction when the sewage in the collection tank reaches a predetermined sewage level so that the interior of the collection tank is pressurized to discharge the sewage from the collection tank through the sewage discharge pipe.

According to the present invention, by operating the vacuum pump so as to rotate in reverse direction, the interior of the collection tank is pressurized to discharge sewage from the collection tank, and hence a sewage pump can be omitted and clogging caused by foreign matter can be avoided. Further, by using a plurality of vacuum pumps, the safety of the operation of the apparatus can be enhanced. Furthermore, since the vacuum pump is employed in the system, the ultimate pressure is high and the operation efficiency is high.

In a preferred aspect of the present invention, the vacuum pump comprises a roots-type vacuum pump.

The roots-type vacuum pump comprises a casing and a pair of roots rotors, and each of the roots rotors has a plurality of lobes. As the roots rotors rotate, a gas which is drawn from an inlet port into the casing is confined between the roots rotors and the casing and delivered toward an outlet port.

In a preferred aspect of the present invention, a power control panel having the controller therein and the plurality of vacuum pumps are unitized to form an integrated unit structure, and the collection tank is installed in a manhole to form an integrated unit structure.

According to the present invention, since a power control panel and a plurality of vacuum pumps are unitized to form an integrated unit structure, and a collection tank is incorporated in a manhole to form an integrated unit structure, the facility structure is simplified and a site for the building is not required, unlike the conventional vacuum-pump type vacuum station.

In a preferred aspect of the present invention, the controller has an operating speed control device for increasing an operation speed of each of the vacuum pumps.

According to the present invention, since an operating speed control device such as an inverter for increasing the operational speed of the vacuum pump is provided in the controller, the speed increasing operation of the vacuum pump can be performed by the operating speed control device. Further, by using a PLC, a small-sized control panel can be constructed, and setting of operation range of the vacuum pump can be varied, and thus the system can cope with wide range of design conditions and the system can operated efficiently.

According to a second aspect of the present invention, there is provided a method for operating a vacuum station, comprising: the vacuum station comprising: a collection tank for collecting sewage; a plurality of vacuum pumps for depressurizing and pressurizing an interior of the collection tank; a sewage inlet pipe connected to the collection tank; a sewage discharge pipe connected to the collection tank; and the method comprising: operating at least one of the vacuum pumps so as to rotate in normal direction so that the interior of the collection tank is depressurized to collect sewage into the collection tank through the sewage inlet pipe; and operating at least one of the vacuum pumps so as to rotate in reverse direction when the sewage in the collection tank reaches a predetermined sewage level so that the interior of the collection tank is pressurized to discharge the sewage from the collection tank through the sewage discharge pipe.

According to the present invention, a sewage pump can be omitted and clogging caused by foreign matter can be avoided. Further, by using a plurality of vacuum pumps, the safety of the operation of the apparatus can be enhanced. Furthermore, since the vacuum pump is employed in the system, the ultimate pressure is high and the operation efficiency is high.

In a preferred aspect of the present invention, wherein a sewage collecting operation mode for operating the at least one of the vacuum pumps so as to rotate in normal direction so that the interior of the collection tank is depressurized to collect the sewage into the collection tank through the sewage inlet pipe, and a sewage discharging operation mode for operating the at least one of the vacuum pumps so as to rotate in reverse direction when the sewage in the collection tank reaches the predetermined sewage level so that the interior of the collection tank is pressurized to discharge the sewage from the collection tank through the sewage discharge pipe are performed alternately.

In a preferred aspect of the present invention, the vacuum pump comprises a roots-type vacuum pump.

In a preferred aspect of the present invention, the plurality of vacuum pumps are operated alternately in the sewage collecting operation mode.

According to the present invention, since the vacuum pumps which are to be operated in the sewage collecting operation mode can be switched alternately, the safety of the operation of the apparatus can be enhanced.

In a preferred aspect of the present invention, after one of the vacuum pumps is operated for a predetermined period of time, when the degree of vacuum in the collection tank does not reach a predetermined value, another vacuum pump is started to operate simultaneously with the one of the vacuum pumps.

According to the present invention, only one of the vacuum pumps is not excessively used, but all of the vacuum pumps are evenly used, and hence the safety of the operation of the apparatus can be enhanced.

In a preferred aspect of the present invention, when switching between the sewage collecting operation mode and the sewage discharging operation mode is performed, the vacuum pump which is in operation is operated so as to rotate in a direction opposite to the direction in which the vacuum pump has been rotated before the switching.

According to the present invention, the time required for pressure fluctuation at the time of switching the mode can be shortened.

The above and other objects, features, and advantages of the present invention will be apparent from the following description when taken in conjunction with the accompanying drawings which illustrates preferred embodiments of the present invention by way of example.

BRIEF DESCRIPTION OF THE DRAWINGS

FIG. 3 is a table showing an example of a list of operating range of a vacuum pump, allowable pressure loss and collectable population.

DETAILED DESCRIPTION OF THE PREFERRED EMBODIMENTS

A vacuum station according to embodiments of the present invention will be described in detail with reference to the drawings.

Figure 1:
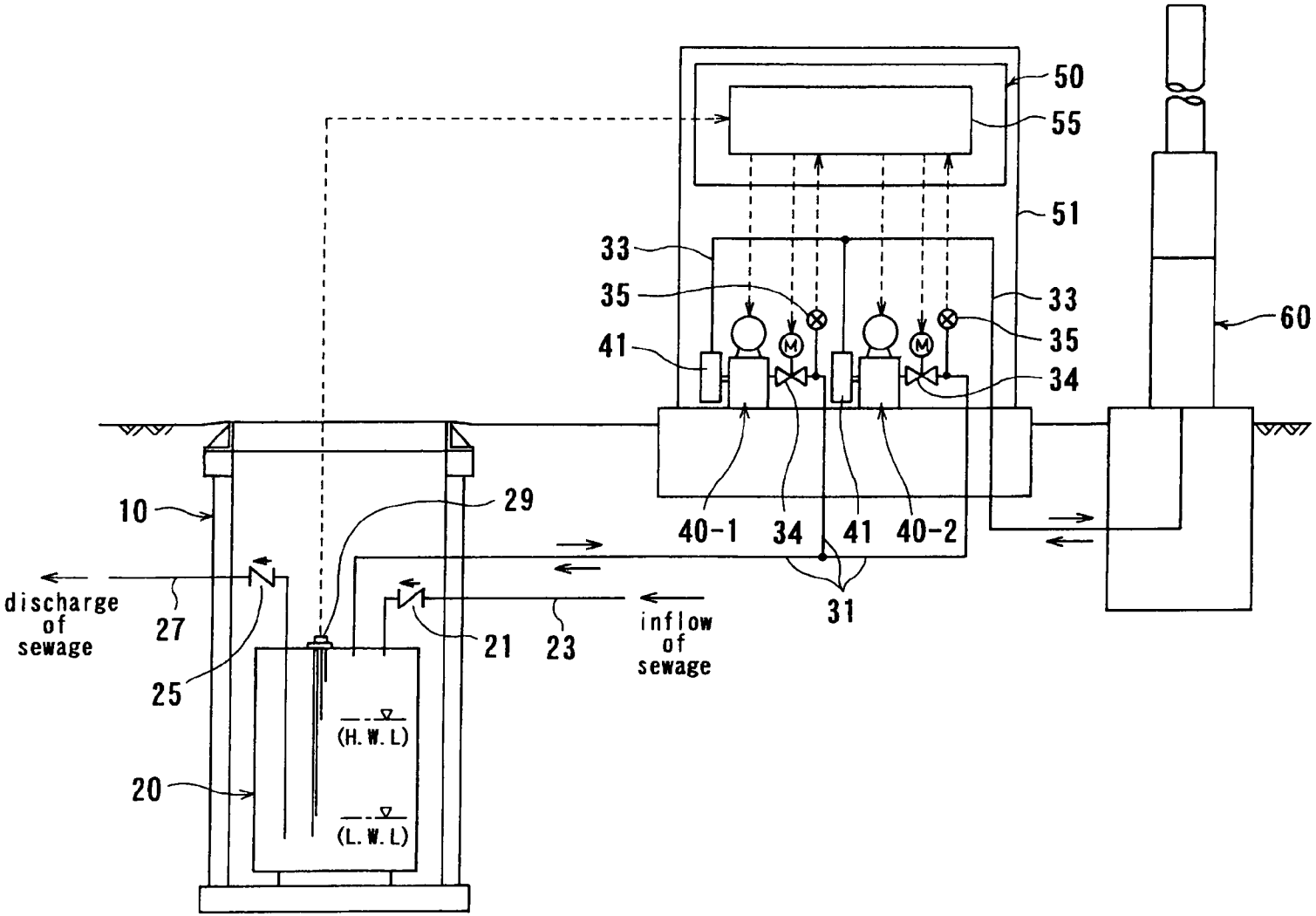
FIG. 1 is a schematic view showing an overall structure of a vacuum station according to an embodiment of the present invention.

FIG. 1 is a schematic view showing an overall structure of a vacuum station according to an embodiment of the present invention. As shown in FIG. 1, a vacuum station comprises a collection tank 20 installed in a manhole 10, two vacuum pumps 40-1 and 40-2 installed on the ground, a power control panel 50 which is unitized together with the vacuum pumps 40-1 and 40-2, and a deodorizing device 60 for deodorizing exhaust from the vacuum pumps 40-1 and 40-2.

Next, components of the vacuum station will be described in detail.

The manhole 10 comprises a normal built-up manhole which is laid underground. The collection tank 20 comprises a single tank, and a sewage inlet pipe (vacuum sewage pipe) 23 is connected to the collection tank 20 through a check valve 21, and a sewage discharge pipe 27 is connected to the collection tank 20 through a check valve 25. Further, a level sensor 29 for detecting a sewage level in the manhole 10 is attached to the collection tank 20. The collection tank 20 comprising a single tank is incorporated in the manhole 10, whereby the collection tank 20 is unitized. On the other hand, the collection tank 20 and the two vacuum pumps 40-1 and 40-2 are connected to each other by supply and discharge pipes 31, the two vacuum pumps 40-1 and 40-2 and the deodorizing device 60 are connected to each other by supply and discharge pipes 33. The two vacuum pumps 40-1 and 40-2 are connected to these supply and discharge pipes 31 and 33 in parallel. A gate valve (motor-driven gate valve) 34 and a pressure sensor 35 are attached to the supply and discharge pipe 31 at the location near the vacuum pump 40-1, and a gate valve (motor-driven gate valve) 34 and a pressure sensor 35 are attached to the supply and discharge pipe 31 at the location near the vacuum pump 40-2. Further, a silencer 41 is attached to the supply and discharge pipe 33 to which the vacuum pump 40-1 is connected, and a silencer 41 is attached to the supply and discharge pipe 33 to which the vacuum pump 40-2 is connected. The vacuum pumps 40-1 and 40-2 comprise a roots-type vacuum pump (roots-type multistage vacuum pump) so that the vacuum pumps 40-1 and 40-2 can be operated in normal rotation and in reverse rotation.

The power control panel 50 comprises a control panel having a controller 55 for controlling operation of the vacuum station, and is disposed at upper part of a cabinet 51. The two vacuum pumps 40-1 and 40-2 are housed in lower part of the cabinet 51, whereby the power control panel 50 and the vacuum pumps 40-1 and 40-2 are unitized to achieve space savings. In order to enable the power control panel 50 and the two vacuum pumps 40-1 and 40-2 to be a unitized structure, the structure is not limited to the structure in which the cabinet 51 is used, but various modification may be made. For example, the two vacuum pumps 40-1 and 40-2 maybe installed in the space defined at the lower part of the power control panel (self-support power control panel) 50, thereby achieving such unitized structure.

Detection signals from the level sensor 29 and the pressure sensor 35 are inputted into the controller 55, and operation of the two vacuum pumps 40-1 and 40-2 and various valves is controlled on the basis of the detection signals. Further, the controller 55 has an operating speed control device such as an inverter for controlling operating speeds of the vacuum pumps 40-1 and 40-2, a PLC (Programmable Logic Controller), and the like. Specifically, the two vacuum pumps 40-1 and 40-2 are controlled so as to obtain respective optimum rotational speeds in accordance with their operating conditions by the operating speed control device such as an inverter. For example, in a case where loads applied to the vacuum pump 40-l or 40-2 are small, the rotational speed of the vacuum pump 40-1 or 40-2 is increased (speed increasing operation), and in a case where loads applied to the vacuum pump 40-1 or 40-2 are large, the rotational speed of the vacuum pump 40-1 or 40-2 is decreased (speed decreasing operation).

The deodorizing device 60 is connected to one end of the supply and discharge pipe 33, and the odor of exhaust drawn in from the collection tank 20 at the time of evacuation by the vacuum pumps 40-1 and 40-2 is removed by the deodorizing device 60 comprising activated carbon or the like. The deodorizing deice 60 allows a gas to pass therethrough at the time of evacuation as well as suction.

Next, a method for controlling operation of the vacuum station will be described below.

Figure 2:
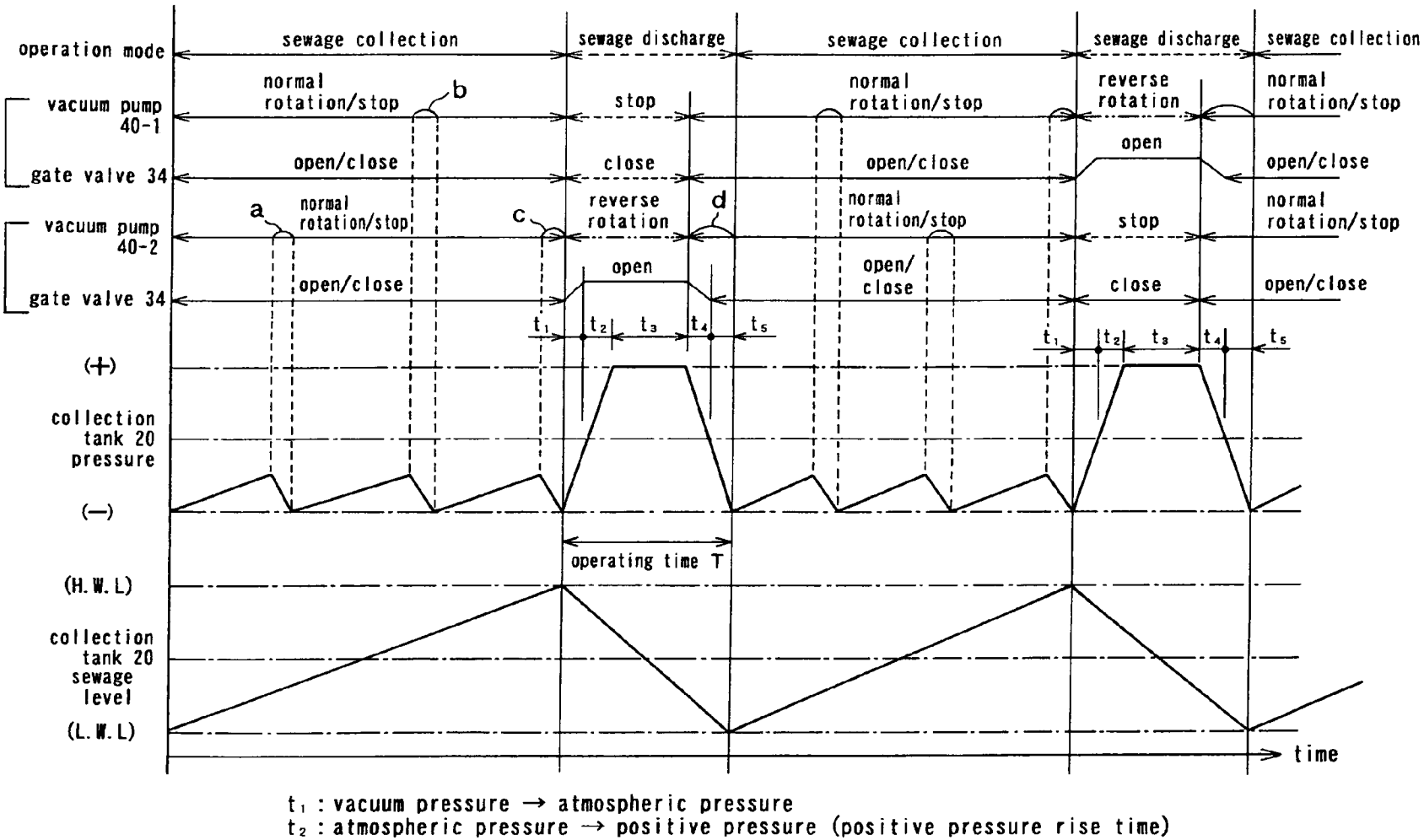
FIG. 2 is a diagram showing the manner in which the vacuum station is operated.

FIG. 2 is a diagram showing the manner in which the vacuum station is operated with the lapse of time. In this operating method, a sewage collecting operation mode in which the vacuum pump 40-1 or 40-2 is rotated in normal direction to depressurize the interior of the collection tank 20 and collect sewage into the collection tank 20 and a sewage discharging operation mode in which the vacuum pump 40-1 or 40-2 is rotated in reverse direction to pressurize the interior of the collection tank 20 and discharge the sewage from the collection tank 20 are performed alternately. This operating method will be described below with reference to FIGS. 1 and 2. In this operation control, the vacuum pumps 40-1 and 40-2, the gate valves 34, and the like are operated on the basis of the detection signals inputted from the various sensors into the controller 55 shown in FIG. 1.

Specifically, in the sewage collecting operation mode, when the degree of vacuum in the collection tank 20 is lowered to a predetermined value (for example, −60 kPa), one of the vacuum pumps 40-1 and 40-2 is started to operate. Thereafter, when the degree of vacuum in the collection tank 20 increases and reaches a predetermined value (for example, −70 kPa), operation of the vacuum pump is stopped. Operation/stop of the vacuum pump 40-1 and operation/stop of the vacuum pump 40-2 are performed alternately. Specifically, in FIG. 2, first, the vacuum pump 40-2 is operated (part a), then the vacuum pump 40-1 is operated (part b), and then the vacuum pump 40-2 is operated (part c). Thus, the degree of vacuum in the collection tank 20 is kept in the range of −60 kPa to −70 kPa at all times, and sewage flows into the collection tank 20 from the sewage inlet pipe 23 and is stored in the collection tank 20. While the vacuum pump 40-1 or the vacuum pump 40-2 is operated (including normal rotation and reverse rotation), the gate valve 34 corresponding to the vacuum pump which is in operation is opened. The gate valve 34 corresponding to the vacuum pump which is not in operation is closed.

After a certain period of time (for example, 30 minutes) has passed after starting of operation of the vacuum pump 40-1 or 40-2, if the collection tank 20 does not reach a predetermined degree of vacuum (for example, −70 kPa), then another vacuum pump 40-2 or 40-1 is simultaneously operated, whereby the system is controlled to allow the collection tank to reach the predetermined degree of vacuum.

In this manner, the sewage collecting operation mode continues to be performed, and when the sewage level in the collection tank 20 reaches a predetermined level (H.W.L), the sewage collecting operation mode is switched to the sewage discharging operation mode in which one of the vacuum pumps 40-1 and 40-2 is started to rotate in reverse direction. In an example shown in FIG. 2, the vacuum pump 40-2 which has been rotating in normal direction when the sewage level in the collection tank 20 reaches the predetermined sewage level (H.W.L) is started to rotate in reverse direction. Specifically, when the vacuum pump 40-2 is operated, the gate valve 34 corresponding to the vacuum pump 40-2 is opened. Therefore, if the vacuum pump 40-2 in operation is rotated in reverse direction, the reverse rotation of the vacuum pump 40-2 is sufficient to perform the function of the system without the need for opening or closing the gate valve 34. Thus, the operation mode can be switched quickly because the time required to open or close the gate valve 34 can be saved. Therefore, when the sewage level in the collection tank 20 reaches the predetermined sewage level (H.W.L) in such a state that any of the vacuum pumps 40-1 and 40-2 is not operated, the vacuum pump 40-1 or 40-2 which has not been rotating in normal direction just before the sewage level in the collection tank 20 reaches the predetermined sewage level should be operated so as to rotate in reverse direction.

As described above, when the vacuum pump 40-2 is operated so as to rotate in reverse direction, the interior of the collection tank 20 is restored to atmospheric pressure promptly, and is then pressurized to positive pressure. When positive pressure in the collection tank 20 reaches a predetermined value, sewage in the collection tank 20 is discharged from the sewage discharge pipe 27 by application of positive pressure. The discharge of the sewage from the collection tank 20 is performed without using a sewage pump, and foreign matter included in the sewage passes through only the sewage discharge pipe 27 and the check valve 25, and hence clogging by foreign matter is unlikely to occur.

When the sewage level in the collection tank 20 is lowered to a predetermined sewage level (L.W.L) by discharge of the sewage, the sewage discharging operation mode is switched to the sewage collecting operation mode again, and one of the vacuum pumps is started to rotate in normal direction. In the example shown in FIG. 2, the vacuum pump 40-2 is started to rotate in normal direction. Specifically, in this case, if the vacuum pump 40-2 which has rotated in reverse direction is switched to the normal rotation (part d), the gate valve 34 is not required to be opened or closed in the same manner as the above, and hence switching from positive pressure to negative pressure can be performed quickly. Thus, this operation method is suitable. Thereafter, in the same manner as the above, collection of sewage into the collection tank 20 and discharge of the sewage from the collection tank 20 are performed alternately by switching between the sewage collecting operation mode and the sewage discharging operation mode.

On the other hand, exhaust from the vacuum pump 40-1 or 40-2 is led to the deodorizing device 60 through the supply and discharge pipe 33 shown in FIG. 1 and deodorized in the deodorizing device 60, and is then discharged to the atmosphere. In the case where the vacuum pumps 40-1 and 40-2 comprise a roots-type vacuum pump, the exhaust has a high temperature at the time of vacuum operation, and thus the supply and discharge pipe 33 and the deodorizing device 60 tend to have a high temperature. However, if the deodorizing device 60 comprises activated carbon, generally the deodorizing device 60 cannot exhibit deodorizing performance at a temperature of about 40° C. or higher. Therefore, conventionally, a cooling device is provided at the exhaust side of the vacuum pump 40-1 or 40-2 to lower the temperature of the exhaust, and the exhaust whose temperature has been lowered is allowed to flow into the deodorizing device. However, in this vacuum station, the vacuum pump which is rotatable in normal and reverse directions is used as the vacuum pumps 40-1 and 40-2, and a gas is allowed to pass through the deodorizing device 60 at the time of evacuation and at the time of suction. Therefore, outer air is allowed to pass through the deodorizing device 60 and the supply and discharge pipe 33 to produce a cooling effect (achieving ambient temperature) at the reverse rotation of the vacuum pump (when sewage is discharged from the collection tank 20). Then, the cooling device is unnecessary, thus lowering the cost of the system and downsizing the system.

In this vacuum station, by switching the rotational direction of the vacuum pump 40-1 or 40-2 connected to the collection tank 20 comprising a single tank, "sewage collection" and "sewage discharge" are alternately repeated, and hence it is necessary to make the time for sewage discharge as short as possible and to make preparations for sewage collection. Particularly, since the pressure in the collection tank 20 becomes atmospheric pressure, i.e. positive pressure at the time of sewage discharge, if the pressure in the collection tank 20 reaches a predetermined vacuum pressure as soon as possible, then the time for sewage discharge can be shortened. Therefore, in this vacuum station, as described above, the controller 55 has the operating speed control device such as an inverter for increasing the operating speed of the vacuum pumps 40-1 and 40-2, and hence the time for sewage discharge (particularly, time t2, t3 and t5 in FIG. 2) can be shortened. In FIG. 2, t1 represents the time when pressure in the collection tank 20 is changed from vacuum pressure to atmospheric pressure, t2 represents the time when pressure in the collection tank 20 is changed from atmospheric pressure to positive pressure (positive pressure rise time), and t3 represents the time for sewage discharge. Further, t4 represents the time when pressure in the collection tank 20 is changed from positive pressure to atmospheric pressure, t5 represents the time when pressure in the collection tank 20 is changed from atmospheric pressure to vacuum pressure (vacuum rise time), and T represents the operating time of the vacuum pump, i.e., the sum of t1, t2, t3, t4 and t5.

Conventionally, the operating vacuum degree of the vacuum pump is in the range of −60 kPa to −70 kPa. However, in this vacuum station, setting of the operating vacuum degree can be changed in accordance with conditions. Next, some setting examples will be described.

Setting Example 1

Setting Example According to Topographical Conditions

In the construction plan of a small-scale vacuum sewage system, expected to be used for about 3 hundred residents, to which the present invention is applied, the houses in the area where the system is installed are located under different conditions. Some houses are located sparsely in a wide area, and others are located densely in a small area. In order to cope with conditions of location flexibly, setting of operating vacuum degree of the vacuum pump is changed and the vacuum pump is controlled on the basis of the setting. The setting of the operating vacuum degree of the vacuum pump tends to affect the operating situations of the system as follows:

1. As the operating vacuum degree of the vacuum pump is higher, the flow rate of air is smaller.

2. As the operating vacuum degree of the vacuum pump is higher, allowable pressure loss which is used for designing the piping of the vacuum sewage system is larger.

Therefore, according to control of the present invention, operating range to be a base is set in accordance with conditions of location on the basis of collectable population of design region and calculation results of loss of a vacuum sewage pipe. An example of the manner in which collectable population and allowable pressure loss are changed according to operating range of the vacuum pump is shown in FIG. 3. As shown in this example, if the degree of vacuum in the operating range is set to a high value in a wide area where houses are located sparsely, and a low value in a small area where houses are located densely, then the system can cope with various topographical conditions.

Setting Example 2

Setting Example According to the Amount of Sewage

In a small-scale plan, since the amount of sewage generated is fluctuated largely depending on time zones, setting of operating range is changed according to the time zones, thereby achieving an economical operation of the system. Specifically, the operation of the vacuum pump is controlled so that the operating range of the vacuum pump is changed to be adjusted for a time zone when the amount of sewage is large in the morning and evening and a time zone when the amount of sewage is small at night. For example, in a time zone when the amount of sewage is large (for example, 6:00–10:00, 18:00–22:00), the degree of vacuum of starting operation of the vacuum pump is set to a high value (for example, −60 kPa) In a time zone when the amount of sewage is small (for example, 1:00–6:00, 13:00–18:00), the degree of vacuum of starting operation of the vacuum pump is set to a low value (for example, −50 kPa). In other time zone (for example, 10:00–13:00, 22:00–1:00), the degree of vacuum of starting operation of the vacuum pump is set to an intermediate value (for example, −55 kPa).

Figure 4A:
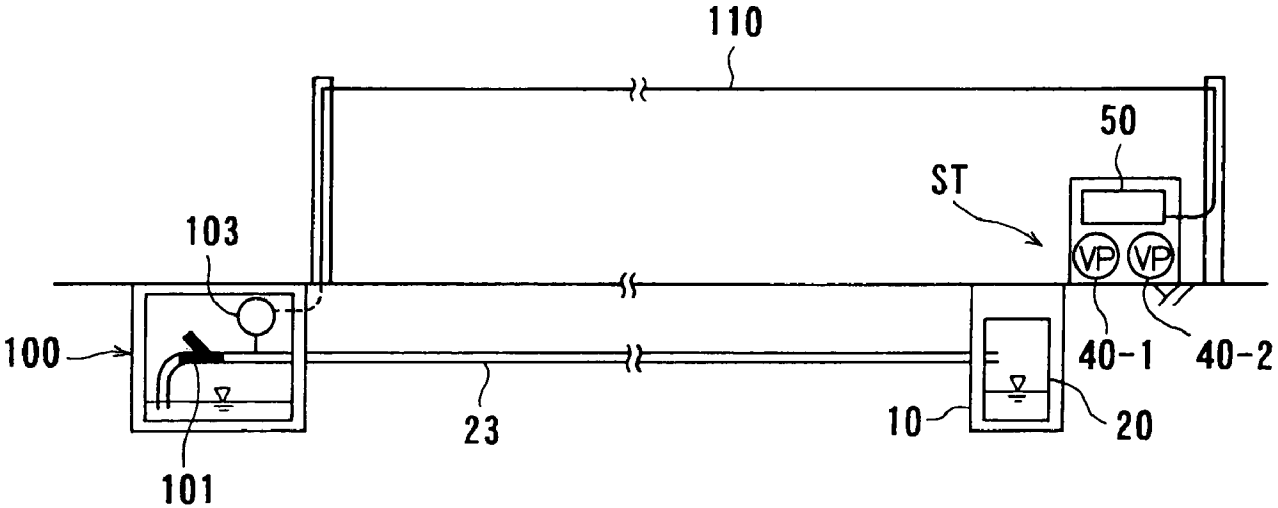
FIGS. 4A and 4B are schematic views showing the manner in which operation of vacuum pumps 40-1 and 40-2 is controlled using a vacuum valve unit 100 provided at an end of the system.
Figure 4B:
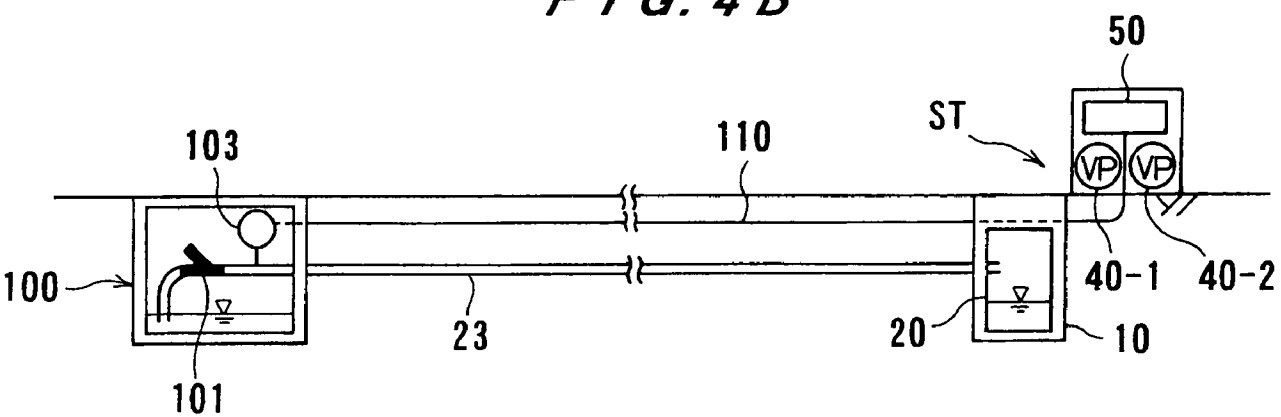

The operation control for ON-OFF of the vacuum pumps 40-1 and 40-2 is normally performed by the degree of vacuum in the collection tank 20, as described above. However, in many cases, in a small-scale vacuum sewage system, a total extension line to the vacuum valve unit located at the end of the line is short. Therefore, as shown in FIGS. 4A and 4B, a small-sized vacuum station ST according to the present invention and the vacuum valve unit 100 located at the end of the line are connected to each other by an aerial signal line 110 (see FIG. 4A) or an underground signal line 110 (see FIG. 4B), whereby operation control of the vacuum pumps 40-1 and 40-2 may be performed by the pressure (pressure in the vacuum sewage pipe 23 transmitted from a pressure transmitter 103) of the vacuum valve unit 100 provided at the end of the line. According to the present invention, the rotational speeds of the vacuum pumps are controlled using the operating speed control device of the controller 55 so that the pressure of the vacuum valve unit 100 provided at the end of the line is kept at the degree of vacuum required for operation of the vacuum valve 101. In this case, the following two control methods are exemplified. If there are a plurality of systems including the vacuum sewage pipes 23, the pressure of the vacuum valve unit 100 provided at the end of each system should be detected and used for controlling.

Method 1

Starting conditions (for example, if the degree of vacuum becomes −25 kPa or less, the vacuum pump 40-1 or 40-2 is started to operate) according to the pressure of the terminal vacuum valve unit 100 are added to a control pattern based on the pressure of the collection tank 20.

Method 2

Setting of the pressure of the terminal vacuum valve unit 100 is in the range of, for example, −25 kPa to −35 kPa, and the vacuum pump 40-1 or 40-2 is operated or stopped so that the pressure is kept within the setting range. During operation, the differential pressure between the pressure of the terminal vacuum valve unit 100 and the pressure of the collection tank 20 is used as a parameter, and the vacuum pump 40-1 or 40-2 is operated such that if the differential pressure increases, the rotational speed of the vacuum pump is increases and if the differential pressure decreases, the rotational speed of the vacuum pump decreases.

In the above embodiments, there is no limit to the number of vacuum pumps, and three or more of vacuum pumps may be provided.

Although certain preferred embodiments of the present invention have been shown and described in detail, it should be understood that various changes and modifications may be made therein without departing from the scope of the appended claims.

What is claimed is:

1. A vacuum station comprising:

a collection tank for collecting sewage;

a plurality of vacuum pumps for depressurizing and pressurizing an interior of said collection tank;

a sewage inlet pipe connected to said collection tank;

a sewage discharge pipe connected to said collection tank; and a controller for controlling said plurality of vacuum pumps;

wherein said controller controls at least one of said vacuum pumps so as to rotate in normal direction so that the interior of said collection tank is depressurized to collect sewage into said collection tank through said sewage inlet pipe, and at least one of said vacuum pumps so as to rotate in reverse direction when the sewage in said collection tank reaches a predetermined sewage level so that the interior of said collection tank is pressurized to discharge the sewage from said collection tank through said sewage discharge pipe;

wherein said plurality of vacuum pumps are roots-type vacuum pumps; and wherein a power control panel having said controller therein and said plurality of vacuum pumps are unitized to form an integrated unit structure, and said collection tank is installed in a manhole to form an integrated unit structure.

2. A vacuum station according to claim 1, wherein said controller has an operating speed control device for increasing an operation speed of each of said vacuum pumps.

3. A method for operating a vacuum station, comprising:

said vacuum station comprising:

a collection tank for collecting sewage;

a plurality of vacuum pumps for depressurizing and pressurizing an interior of said collection tank;

a sewage inlet pipe connected to said collection tank;

a sewage discharge pipe connected to said collection tank; and said method comprising:

operating at least one of said vacuum pumps so as to rotate in normal direction so that the interior of said collection tank is depressurized to collect sewage into said collection tank through said sewage inlet pipe; and operating at least one of said vacuum pumps so as to rotate in reverse direction when the sewage in said collection tank reaches a predetermined sewage level so that the interior of said collection tank is pressurized to discharge the sewage from said collection tank through said sewage discharge pipe;

wherein a sewage collecting operation mode for operating said at least one of said vacuum pumps so as to rotate in normal direction so that the interior of said collection tank is depressurized to collect the sewage into said collection tank through said sewage inlet pipe, and a sewage discharging operation mode for operating said at least one of said vacuum pumps so as to rotate in reverse direction when the sewage in said collection tank reaches the predetermined sewage level so that the interior of said collection tank is pressurized to discharge the sewage from said collection tank through said sewage discharge pipe are performed alternately;

wherein said plurality of vacuum pumps are roots-type vacuum pumps; and wherein said plurality of vacuum pumps are operated alternately in said sewage collecting operation mode.

4. A method according to claim 3, when switching between said sewage collecting operation mode and said sewage discharging operation mode is performed, said vacuum pump which is in operation is operated so as to rotate in a direction opposite to the direction in which said vacuum pump has been rotated before said switching.

* * * * *